US007819683B2

(12) United States Patent
Nicholson

(10) Patent No.: US 7,819,683 B2
(45) Date of Patent: Oct. 26, 2010

(54) CONTACT PIN ASSEMBLY FOR A HIGH VOLTAGE ELECTRICAL CONNECTION

(75) Inventor: Joseph Allan Nicholson, Cumbria (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/689,921

(22) Filed: Jan. 19, 2010

(65) Prior Publication Data

US 2010/0115769 A1 May 13, 2010

Related U.S. Application Data

(62) Division of application No. 12/162,308, filed as application No. PCT/GB2006/004582 on Dec. 8, 2006, now Pat. No. 7,674,124.

(30) Foreign Application Priority Data

Jan. 26, 2006 (GB) ..... 0601609.1

(51) Int. Cl.
*H01R 13/52* (2006.01)

(52) U.S. Cl. ..... 439/281

(58) Field of Classification Search ..... 439/281, 439/587, 589, 736, 935; 174/152 GM
See application file for complete search history.

(56) References Cited

U.S. PATENT DOCUMENTS 6,506,083 B1 * 1/2003 Bickford et al. ..... 439/736
7,442,081 B2 * 10/2008 Burke et al. ..... 439/589
7,452,247 B1 * 11/2008 Rahman et al. ..... 439/736
7,479,035 B2 * 1/2009 Bence et al. ..... 439/583
7,581,989 B1 * 9/2009 Wheatley ..... 439/589

* cited by examiner

*Primary Examiner*—Khiem Nguyen
(74) *Attorney, Agent, or Firm*—Brandon S. Clark; Rodney V. Warfford; Daryl R. Wright

(57) ABSTRACT

There is disclosed a contact pin assembly for a high voltage electrical connection, the contact pin assembly comprising:

an electrically-conductive outer member which is supportable from a support member, the outer member having a bore extending therethrough, the bore defining a smooth inner face of the outer member and being divergent towards opposite ends of the outer member;

a contact pin, ends of which are arranged to be connected directly or indirectly to cables, the contact pin extending through the bore and having a profiled portion which defines a smooth outer face of the contact pin and which is divergent towards opposite ends of the contact pin, the contact pin being concentric with the bore;

an electrically-conductive layer provided adjacent the inner face, the electrically-conductive layer being in electrical communication with the outer member and conforming with the profile of the inner face;

an annular space between the profiled portion and the electrically-conductive layer;

electrical insulation surrounding the pin to provide a seal around the pin and filling the annular space; and sealing between the insulation and the ends of the outer member.

There is also disclosed a method of manufacturing such a contact pin assembly.

12 Claims, 5 Drawing Sheets

CONTACT PIN ASSEMBLY FOR A HIGH VOLTAGE ELECTRICAL CONNECTION

This application is a Divisional of U.S. application Ser. No. 12/162,308, filed Jul. 25, 2008, which is a 371 of International Application No. PCT/GB2006/004582 filed on Dec. 8, 2006, which claimed priority from Great Britain Application No. 0601609, filed Jan. 26, 2006, incorporated herein.

The present invention relates to a contact pin assembly for an electrical connection, the assembly being particularly suited for high voltage applications. The present invention also relates to a contact pin assembly with improved sealing characteristics. In addition, the present invention relates to an associated method of manufacturing a contact pin assembly.

The invention has been devised in particular, though not necessarily solely, for underwater applications, particularly high power bulkhead penetrations and, more generally, bushings through metal enclosures.

Extraction of heavy or crude oil, by way of subsea wellheads, generally requires the use of electrical submersible pumps (ESPs). Subsea extraction systems require electrical connection through a subsea wellhead, in shallow or deep water (20-10,000 ft (5-3,000 m)), where space through the wellhead is restricted.

In deep water applications, high horse power pump systems are more economical and necessitate system voltages of around 4-8 kVac. In addition, wellhead electrical connectors may be subjected to differentiate pressures of up to 5,000 psi (34.5 MPpa) and temperatures as high as 120 C.

In order to ensure connection reliability throughout a 20 year operational life, the electrical connection must have insulated contacts and must be configured to manage the electrical field therethrough in a way which prevents accumulation of high electrical stresses that can give rise to electrical discharges and consequent premature failure of the insulation. Critical in this regard is the minimisation or elimination of air voids, across which electrical discharges can occur in the presence of an alternating current, as used for example on a rotating pump system, such discharges often causing carbonaceous deposits and degradation of the insulation, creating electrical field imbalances and associated even higher electrical stresses, thus creating a runaway effect and premature catastrophic failure.

In addition to providing electrical insulation, contact insulators may be required to provide a gas-tight seal resistant to differential pressures which may be of the order of 5,000 psi (34.5 MPa) or higher. In applications involving extraction of crude oil by gas-lifting methods, gas must be injected into a well formation at high pressure boosting reservoir pressure, and requiring the connector system to serve also as a barrier in the operation of a subsea wellhead. To this end, the insulation must be resistant to gas migration and explosive decompression, which can affect elastomeric seals as a result of gas permeation into the material and subsequent expansion as pressure is released.

According to a first aspect of the invention, there is provided a contact pin assembly for a high voltage electrical connection, the contact pin assembly comprising:

an electrically-conductive outer member which is supportable from a support member, the outer member having a bore extending therethrough, the bore defining a smooth inner face of the outer member and being is divergent towards opposite ends of the outer member;

a contact pin, ends of which are arranged to be connected directly or indirectly to cables, the contact pin extending through the bore and having a profiled portion which defines a smooth outer face of the contact pin and which is divergent towards opposite ends of the contact pin, the contact pin being concentric with the bore;

an electrically-conductive layer provided adjacent the inner face, the electrically-conductive layer being in electrical communication with the outer member and conforming with the profile of the inner face;

an annular space between the profiled portion and the electrically-conductive layer;

electrical insulation surrounding the pin to provide a seal around the pin and filling the annular space; and sealing between the insulation and the ends of the outer member.

In a preferred embodiment of the invention, the electrically-conductive layer is spot welded to the inner face. Spot-welding not only secures the electrically-conductive layer to the inner face but also effects the electrical communication between the electrically-conductive layer and the outer member.

The profiled portion defines a waisted profile which renders the pin thinner at an intermediate position therealong than at its ends whilst providing a smooth transition in the thickness or diameter of the pin along the length of the profiled portion. Similarly, the smooth inner face of the electrically-conductive member and the divergence of the bore towards opposite ends of that member provide a space, into which the profiled profile is received, which has, at an intermediate portion along the length of the outer member, a diameter or transverse dimension which is less than that at the ends of the outer member and which provides a smooth transition to the diameter or transverse dimension along the length of the outer member. In a preferred embodiment, the bore is configured like a Venturi.

Owing to the configuration of the bore and the profiled portion of the pin, as well as the concentricity between the pin and the bore, the assembly effectively "funnels" the electric field into and out of a constricted space, without giving rise to significant electrical stresses. Furthermore, the electrically-conductive layer provides a screen which forms an intimate contact to the insulation and which is electrically connected to the outer member, thereby dissipating electrical charge.

According to a preferred feature of the invention, the bore and profiled portion are each divergent from a respective intermediate position therealong and the intermediate positions are aligned axially.

According to a further preferred feature of the invention, the annular space has a thickness which is substantially constant therealong. As a result, the thickness of the insulation may be correspondingly constant to promote even electrical field distribution.

According to a preferred feature of the invention, the ends of the outer member are covered by the insulation. In this way, the ends may be submerged in the insulation. According to a further preferred feature of the invention, the ends of the outer member are each provided with at least one radially outwardly projecting portion extending therearound, the or each radially outwardly projecting portion being surrounded by a shallower portion of said insulation, whereby stresses induced by a greater degree of radial shrinkage of deeper portions of said insulation to either side said reduced thickness draw the insulation over the or each projecting portion to ensure annular sealing between the insulation and the or each projecting portion. The ends of the outer member are thus configured with a profile such that, as the insulation shrinks during moulding the insulation is stretched around and/or over the or each projecting portion to form a gas-tight pressure seal.

According to a preferred feature of the invention, shrinkage-induced stresses force the insulation radially inward against the pin to ensure sealing around the pin.

In addition, because the profiled portion and bore are wider at their ends, axial pressure, as created by a pressure differential between the ends of the contact pin, will create a locking effect, as the insulation within the outer member is forced against the constriction presented by the outer member and as the profile portion is, similarly, forced against the constriction presented by the insulation. Sealing between the insulation and the inner face at the end of the outer member where the pressure acts is thus enhanced also. Owing to the advantageous sealing characteristics provided by the invention, the need for conventional seals such as O-rings or labyrinth seals is eliminated, as is the need to provide grooves for such seals in the pin insulation or housing which, in the presence of high voltages, create high electrical stresses due to groove edges and air entrapped in the seal, possibly leading to premature failure as outlined above.

Moreover, the elimination of grooves and the like reduces the thickness of insulation which must surround the contact pin, thus allowing for a design having a more compact transverse dimension.

According to a second aspect of the invention, there is provided a method of manufacturing a contact pin assembly for a high voltage electrical connection, the method comprising:

providing an outer member, to be supportable from a structure, the outer member having a bore extending therethrough, the bore defining a smooth inner face of the outer member and being divergent towards opposite ends of the outer member;

providing an electrically-conductive layer adjacent the inner face;

causing the electrically-conductive layer to conform with the profile of the inner face and to be in electrical communication with the outer member;

providing a contact pin, the contact pin having ends which are adapted to be connected directly or indirectly to cables and having a profiled portion which defines a smooth outer face of the contact pin and which is divergent towards opposite ends of the contact pin;

arranging the contact pin within the bore such that the profiled portion is concentric with the inner face, to define an annular space between the profiled portion and the outer face;

providing insulation such that the insulation surrounds the pin to provide a seal around the pin and fills the annular space; and effecting sealing between the insulation and the ends of the outer member.

Preferred embodiments of the present invention will now be described in detail with reference to the accompanying drawings, in which.

Figure 1A:
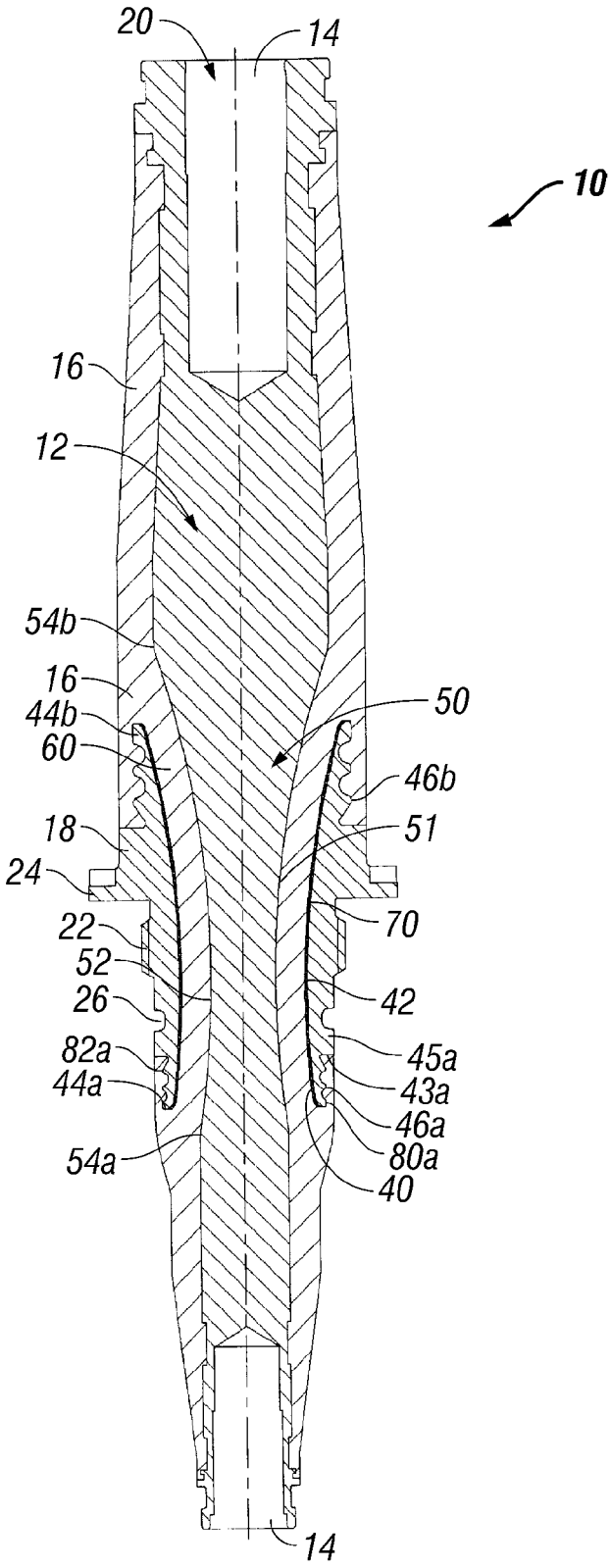
FIG. 1A is a longitudinal cross-sectional view of a contact pin assembly according to a first embodiment.
Figure 1B:
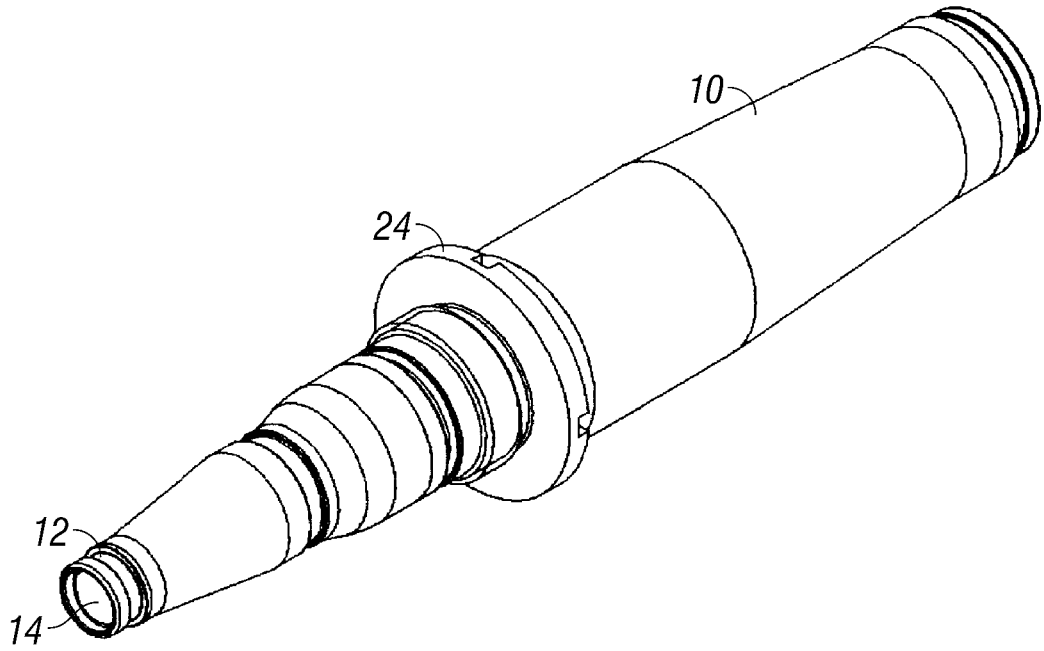
FIG. 1B is a perspective view of the assembly shown in FIG. 1A.

The contact pin assembly 10 according to the first embodiment is shown in FIGS. 1A and 1B. The assembly 10 comprises a central contact pin 12 which is provided at each end with openings 14 appropriately configured to receive plug-in contacts provided at ends of cable conductors for connection to the cable conductors.

In this embodiment, the piece to be connected to one end of the pin 12 differs in diameter from the piece to be connected at the other end of the pin 12, hence the differences between pin diameter and opening diameter at the end of the pin 12.

The pin 12 is surrounded by insulation 16 which extends from one end of the pin 12 to the other. In this embodiment, the insulation is polyetheretherketone (PEEK) which is a high performance thermoplastic particularly suited for this application. Other thermoplastic materials may be used in place of PEEK. Thermoplastic materials are preferable to composite materials such as glass reinforced epoxies, because they have a higher operating temperature, are generally chemically more inert, and are more resistant to mechanical shock and bending loads.

The contact pin 12 is machined from copper. The contact pin 12 is electroplated with either gold or silver plate to prevent oxidation. The assembly 10 further comprises an outer member 18 having a bore 20 through which the pin 12 and insulation 16 pass, which is machined from stainless steel, inconel or similar. The outer member 18 acts as a stress control ring which makes the contact pin assembly particularly suited for a high voltage electrical connection, as will be described in further detail later.

Figure 2:
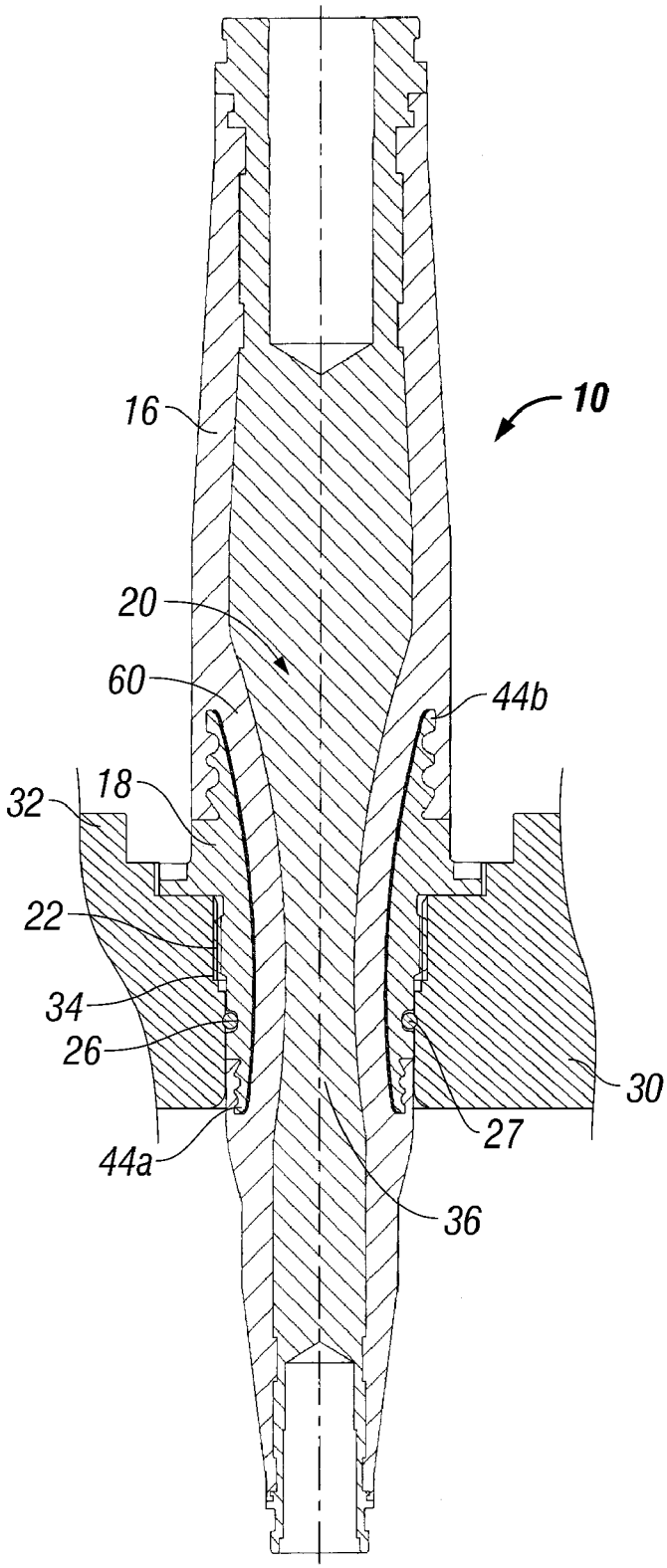
FIG. 2 is a view of the contact pin assembly of the first embodiment of the invention, as mounted to a support member.

The outer member 18 is arranged to be supported from a support member which, in the case of this embodiment is the plate 30 of a subsea bulkhead 32, as can be seen in FIG. 2. To this end, the outer member 18 is provided with an external threaded portion 22 which is engageable with a corresponding threaded portion 34 provided in a bore 26 through the plate 30. The outer member 18 is further provided with a flange portion 24 which is engageable with the plate 30, so as to locate the outer member 18 axially.

The outer member 18 is also provided with an exterior annular groove 26 which receives an O-ring 27 to form a seal between an outer annular face of the outer member 18 and an opposing inner annular face of the bore 36, and thus a seal between the support member and the assembly 10.

The bore 20 defines an inner face 40 of the outer member 18, the inner face 40 being smooth in that it has no edges, points or discontinuities. In other words, there is a smooth transition in diameter along the length of the bore 20.

The bore 20 is divergent from an intermediate position 42 therealong towards opposite ends 44*a*, 44*b* of the outer member 18. In the case of this embodiment, because the diameter of the pin at one end is greater than the diameter of the pin at the other, the intermediate position is not located midway along the length of the outer member 18 but is closer to the end of the pin having the smaller diameter.

In this embodiment, the bore 20 is configured like a Venturi.

The pin 12 is provided with a profiled portion or "waisted portion" 50, that portion defining an outer face 51 of the pin which is also smooth, in that has no edges, points or discontinuities, such that there is a smooth transition in diameter along the length of the profiled portion 50. The profiled portion 50 is similarly divergent from an intermediate position 52 therealong towards opposite ends 54*a*, 54*b* thereof. The pin 12 is arranged such that the profiled portion 50 and bore 20 are concentric and such that the intermediate positions 42 and 52 are axially aligned.

The contact pin assembly 10 further comprises an electrically-conductive layer as provided by a steel mesh 70 positioned adjacent the inner face 40 so as to cover the entirety of the inner face 40, and conforming with the profile of the inner face 40. The mesh 70 is spot welded at the ends 44*a*, 44*b* of the outer member 18, so as to secure it to the outer member 18 and so as to ensure that the mesh 70 is electrically earthed to the outer member 18.

The mesh 70 contains apertures. During manufacture of the assembly 10, the insulation 60 is fluidised and injected into the bore 20 and flows through the apertures such that the mesh 70 becomes at least partially submerged therein. This unitises the mesh 70 and insulation 60 whereby the incidence of voids between the insulation 16 and the mesh 70 is minimal or non-existent.

As a result of the profiles of the pin 12 and mesh 70, an insulation 16 60, defined between the mesh 70 and the inner face 40, which is filled by insulation 16, is of a substantially constant thickness between the ends 44*a* and 44*b* of the outer member 18. The insulation 16 as occupying that annular space 60 is thus, correspondingly, of a substantially uniform thickness.

Because the mesh 70 is in electrical communication with the outer member 18 and has a matching smooth profile, it serves as a shield within which the electrical field created by current through the pin 12 is highly managed. Moreover, owing to there being few, if any, voids between the mesh 70 and insulation 16 the incidence of electrical stress concentration and undesirable electrical discharges in the insulation is reduced.

In other embodiments, foil containing apertures may be used instead of mesh.

Figure 1C:
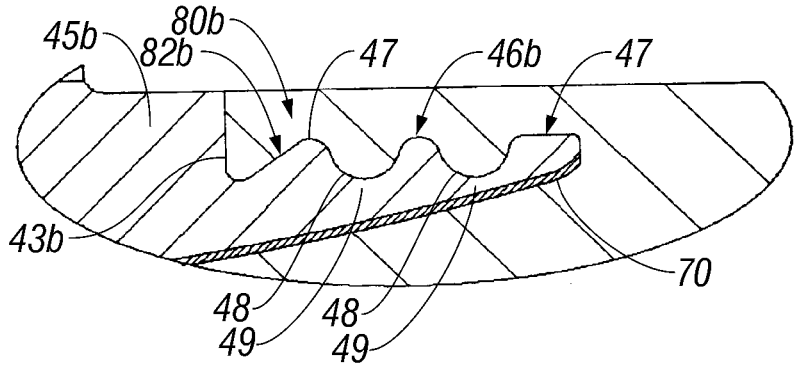
FIG. 1C is a detailed cross-sectional view of an end of an outer member of the assembly shown in FIG. 1A.

As can be seen in FIG. 1A, the ends 44*a* and 44*b* of the outer member 18 are provided with respective wave-like external profiles 46*a* and 46*b*, as can be seen in greater detail for the end 44*b* in FIG. 1C. It will be appreciated that the configuration of that profile is substantially the same at the other end 44*a*.

The ends 44*a*, 44*b* are covered by, or submerged in, the insulation 16 so as to enhance sealing between the insulation 16 and the outer member 18. The wave-like profiles 46*a*, 46*b* define radially outwardly projecting portions in the form of peaks 47, and also define troughs 48. The peaks 47 are each surrounded by a shallower portion of insulation 16 and the troughs 48 are surrounded by deeper portions of the insulation 16. As a result, when the insulation 16, which is provided in heated and fluidised form during manufacture, cools, the deeper portions shrink radially to a greater extent than the shallower portions, giving rise to a hoop stress in the insulation 16 which causes the shallower portions to be drawn around the peaks, thus ensuring a gas-tight seal between the insulation 16 and the ends 44*a*, 44*b* of the outer member 18. Similarly, when the insulation 16 surrounding the pin 12 cools and solidifies, shrinkage/thermal contraction induces hoop stresses in the insulation 16 which force the insulation radially inward against the pin 12 to ensure sealing around the pin 12.

The wave-like profiles 46*a*, 46*b* may also afford the ends 44*a* and 44*b* a degree of radial compliance, i.e. an ability to be deflected radially inward to a degree, under the influence of external acting pressure, which may also enhance sealing between the ends 44*a*, 44*b* and the insulation 16.

Submerging of the ends 44*a*, 44*b* in the insulation gives rise to cover portions 80*a*, 80*b* radially inner faces of which are similarly provided with a wave-like profile 82*a*, 82*b* which is complementary to the wave-like profile on to the respective ends 44*a*, 44*b*. Radially inward pressure acting upon the cover portions 80*a*, 80*b* forces the complementary pairs of wave-like profiles against each other, which may further enhance sealing. As can be seen in FIGS. 1A and 1C, the end portions 44*a*, 44*b* are fully submerged in the insulation 16.

The wave-like profiles 46*a* and 46*b* are subjected to shot blasting during manufacture of the outer member 18 and subsequently coated with a fluoro-elastomer compliant layer, which is resistant to moulding temperatures during manufacture (of up to 420 C) to promote sealing and/or bonding between the ends 44*a*, 44*b* and the cover portions 80*a*,80*b*.

The outer member 18 is further provided with radially outwardly extending portions 45*a*, 45*b* which are disposed axially inwardly of the ends 44*a*, 44*b* respectively, so as to define shoulders 43*a*, 43*b* against which axially inward ends of the cover portions 80*a*, 80*b* are received such that the exteriors of the cover portions at those ends are flush with the projecting portions at the shoulders.

Figure 3:
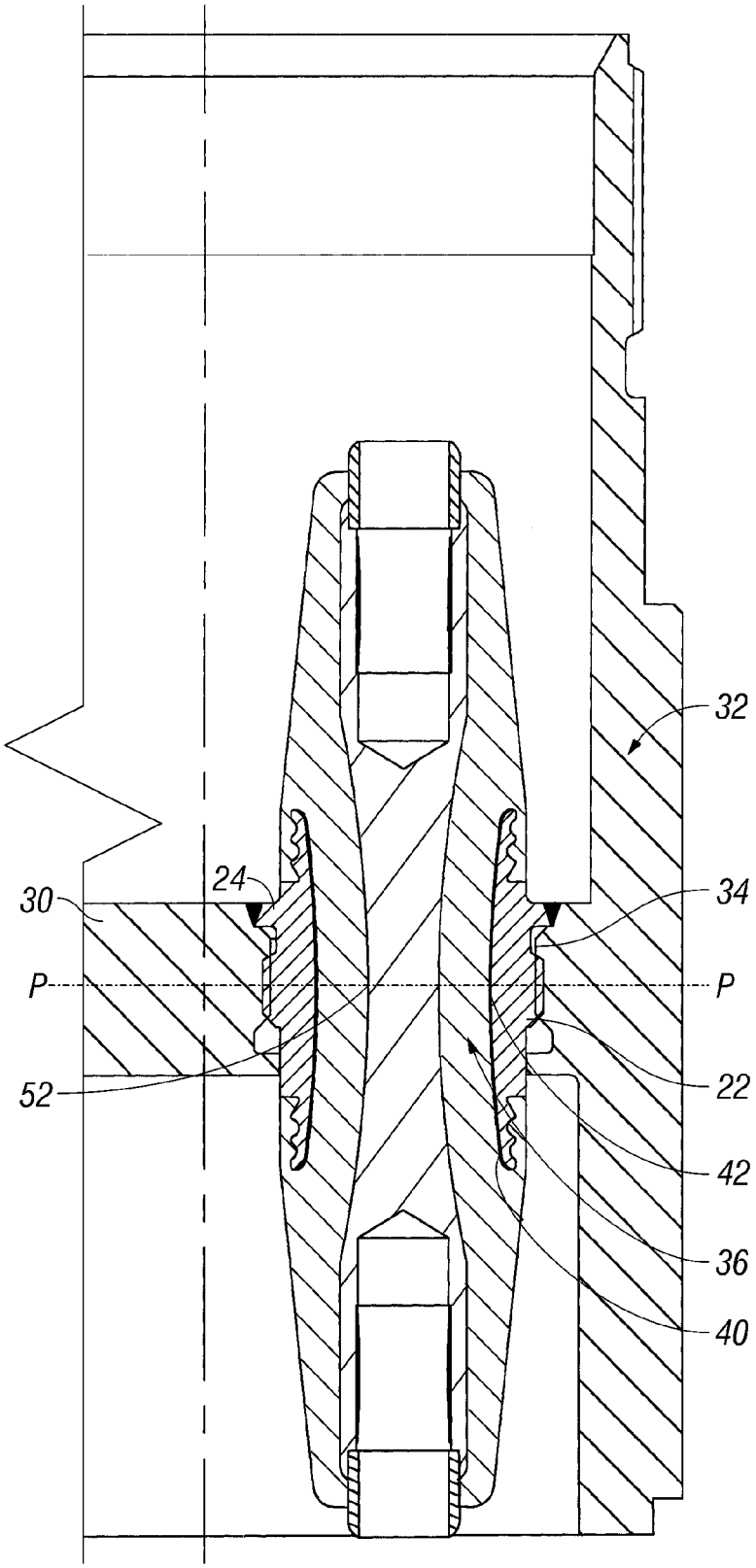
FIG. 3 is a view of a contact pin assembly according to a second embodiment of the invention, as mounted to a support member.

The contact pin assembly 10 according to the second embodiment is shown in FIG. 3, wherein like reference numerals are used to denote like features. The second embodiment is identical in most respects to the first embodiment, having differences as follows.

Firstly, the second embodiment comprises a pin 12 having the same diameter at each end and thus a profiled portion 50 and bore 20 which are symmetrical about a transverse plane P.

Secondly, the second embodiment, the outer member is not provided with groove 26 and instead comprises a flange portion 24 which is arranged to be electron-beam welded to the plate 30 so as to create a seal between the flange portion 24 and the axially facing surface of the plate 30. To facilitate welding, the flange portion 24 is bevelled to accommodate a weld which provides an annular seal between the outer member 18 and the plate 30. Such a weld would not be possible in conventional contact pin assemblies because such assemblies do not have integrally-moulded stress control collars.

Figure 4A:
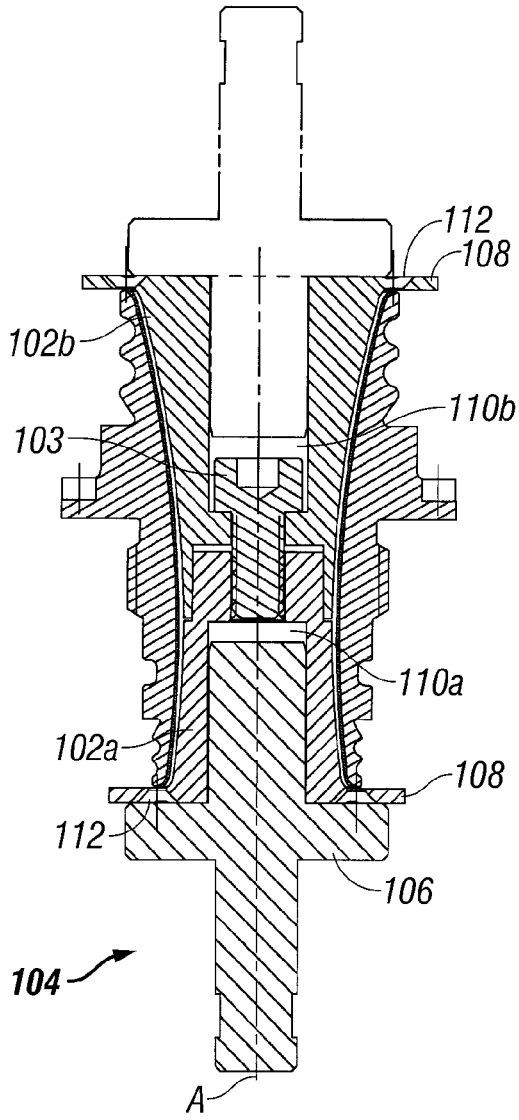
FIG. 4A is a cross-sectional view depicting a stage in the manufacture of a contact pin assembly, in accordance with a third embodiment of the present invention.
Figure 4B:
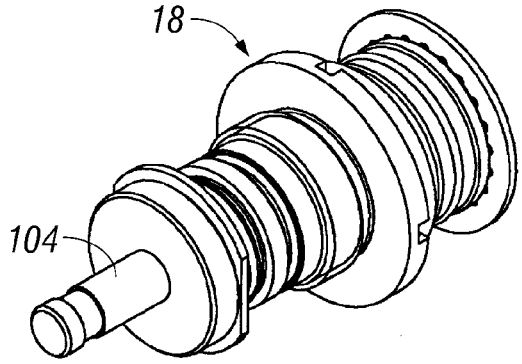
FIG. 4B is a perspective view of the arrangement shown in FIG. 4A.

The method of manufacture of the contact pin assembly 10 will now be described with reference to FIGS. 4A and 4B.

The outer member 18 is first machined from stainless steel or inconel or the like. Next, the steel mesh 70 is cut from flat sheet using a template, rolled around a bar so as to be placed into a tubular form and then placed against the inner face 40 in the bore 20 so that it covers the entirety of the to inner face 40.

Electrically conductive forming members 102*a*, 102*b* are then introduced into the bore 20 from either end thereof. The forming members 102*a*, 102*b* are provided with through bores 110*a*, 110*b* which allow a threaded member to connect the forming members 102*a*, 102*b* to each other. The forming members 102*a*, 102*b* are profiled and sized such that, when they are inserted into the bore and connected, they conform closely to the profile of the bore 40 and there is no transverse play between the forming members and the outer member 18. The forming members thus hold the mesh 70 against the inner face 40. The ends of the forming members 102*a*, 102*b* meet at the intermediate position 42 to be subsequently joined by the connecting member 103.

The assembly comprising the outer member 18, mesh 70 and forming members 102*a*, 102*b* is then mounted on a spot welding jig (not shown), as follows.

The spot welding jig comprises a spindle 104 which functions as an electrode and which is fittingly received into the bore of one (and subsequently the other) of the forming members to locate the forming member radially, such that the outer member 18 is concentric with an axis of rotation A of the spindle 104. The spindle 104 comprises a flange 106 against which is received a flange 108 provided on the forming member to support the forming member from beneath.

Welding apertures 112 are arranged around the flange 108 of each forming member. The welding jig is operated to rotate around the spindle 104, and thus the assembly, so as to bring an aperture 112 into axial alignment with an electrode (not shown) of the welding jig positioned above the assembly. The electrode is then axially advanced into the aperture 112, whereupon an electrical connection between the electrode and the spindle 104, through the assembly, is established and a spot weld between the mesh 70 and the upper end of the outer member is performed. The electrode is then retracted and the spindle rotated to position the next aperture 112 below the electrode. The electrode is again advanced to perform another spot weld between the mesh 70 and the upper end of the outer member. The steps of retracting the electrode, rotating the spindle and advancing the electrode to perform a spot weld are repeated until an arrangement of spot welds between the mesh and the outer member is provided around the circumference of the upper end of the outer member to secure the mesh to the outer member.

The assembly is then removed from the jig, turned upside down and refitted to the jig so that the spindle 104 is fittingly received into the bore of the other of the forming members such that the outer member is again concentric with axis A and the assembly is supported in the same way as described above. Spot welding of the mesh 70 to the outer member 18 is is then performed, this time at the other end of the outer member 18, in exactly the same manner as described above, whereby an arrangement of spot welds between the mesh and the outer member is provided around the circumference of that end, to secure the mesh to the outer member.

The spot welds provide an electrical earth between the mesh 12 and the outer member 18 and also a thermal mechanical attachment of the mesh to the outer member.

Following securing of the mesh 12 to the inner face such that the mesh 12 closely conforms with the profile of the inner face, the outer member 18, complete with mesh 12, is removed from the jig 100 and excess mesh removed by abrasive paper. The assembly is then shot blasted and conformal coating applied. Next, the assembly is loaded into a mould tool cavity for moulding. The contact pin 12 is then introduced through the bore 20 and positioned in the mould tool cavity such that its profiled portion is concentric with the bore 20 and such that the intermediate position 52 of the profiled portion 50 is axially aligned with the intermediate position of the bore 40. The outer member 18 and contact pin are preheated and the insulation 16 is injected into the tool cavity under high pressure (greater than 1000 bar) using a conventional injection moulding machine.

Use of such high moulding pressures prevents the formation of air voids as air is ejected from the tool cavity along split lines thereof (not shown), the split lines being carefully vented to remove the air.

During injection moulding of the insulation under high pressure, the insulation 16 flows through the apertures in the mesh 70, the mesh 70 being in turn, supported by the outer member 18, which offers resistance to the pressure, to maintain the conformance of the mesh 70 to the profile of the inner face 40. As a result of the insulation 16 penetrating the apertures, the screen as formed by the mesh 70 effectively becomes a part of the insulation structure so that, as the insulation 16 shrinks during cooling, voids are unlikely to form between the mesh 70 and the insulation 16. The formation of any voids is thus substantially restricted to the outside of the mesh 70, and are thus inconsequential because the mesh 70 is earthed to the outer member 18.

Advantageously, shrinkage and solidification of the insulation material during cooling results in the creation of a hoop stress in the insulation 16 which, as described above, gives rise to improved sealing characteristics.

Next, the insulation is dressed and machined and final quality checks are then carried out using partial discharge testing techniques. Such techniques involve the use of specialised equipment to detect the level of discharge in the assembly 10 when subjecting the contact pin 12 to a prescribed voltage depending on the voltage level of the contact pin assembly. Discharge levels are detected as a unit of charge in picocoulombs (pC) in accordance with IE60502 standards. Typical levels of acceptance are less than 10 pC at the test voltage which is 1.73×Uo, where Uo is the phrase-to-ground voltage potential.

The provision of the outer member 18, which acts as a stress control ring, as an integral part of the high voltage contact pin assembly allows a variety of sealing methods to be adopted without altering the electrical field patterns. Depending on the application, the outer member 18 can be welded to a bulkhead housing or another support which might be aboveground or subsea, and/or can be fitted with O-ring seals or metal seals and screwed into position using a castellated tightening tool.

The invention claimed is:

1. A method of manufacturing a contact pin assembly for a high voltage electrical connection, the method comprising:

providing an outer member, to be supportable from a structure, the outer member having a bore extending there through, the bore defining a smooth inner face of the outer member and being divergent towards opposite ends of the outer member;

providing an electrically-conductive layer adjacent the inner face;

causing the electrically-conductive layer to conform with the profile of the inner face and to be in electrical communication with the outer member;

providing a contact pin, the contact pin having ends which are adapted to be connected directly or indirectly to cables and having a profiled portion which defines a smooth outer face of the contact pin and which is divergent towards opposite ends of the contact pin;

arranging the contact pin within the bore such that the profiled portion is concentric with the inner face, to define an annular space between the profiled portion and the outer face;

providing insulation such that the insulation surrounds the pin to provide a seal around the pin and fills the annular space; and effecting sealing between the insulation and the ends of the outer member.

2. A method according to claim 1 comprising spot welding the electrically-conductive layer at positions there around to secure the electrically-conductive layer to the ends of the outer member and to provide the electrical communication between the electrically-conductive layer and the outer member.

3. A method according to claim 1, comprising:

providing the outer member with ends having at least one radially outwardly projecting portion extending therearound, and providing the insulation heated and such that the or each radially outwardly projecting portion is surrounded by a shallower portion of said insulation and such that deeper portions of said insulation are provided to either side of said shallower portion; and allowing the insulation to cool such that stresses induced by a greater degree of radial shrinkage of the deeper portions draw the insulation over the or each projecting portion to ensure annular sealing between the insulation and the or each projecting portion.

4. A method according to claim 3, comprising providing the ends of the outer member with a wave-like external profile, the wave-like external profile comprising at least one peak which defines the at least one radially outwardly projecting portion.

5. A method according to claim 1, comprising:

providing the insulation heated; and allowing the insulation to cool such that stresses induced by shrinkage of the insulation force the insulation radially inward against the pin to ensure sealing around the pin.

6. A method according to claim 1, wherein the sealing between the insulation and the ends of the outer member is provided by the insulation.

7. A method according to claim 6, comprising fluidising insulation to render it injectable and injecting the fluidised insulation into the annular space.

8. A method according to claim 6, wherein the electrically-conductive layer comprises apertures there through and the annular space is filled with insulation such that the insulation flows into the apertures to occupy the apertures.

9. A method according to claim 6, comprising causing the electrically-conductive layer to be submerged in the insulation.

10. A method according to claim 1, comprising attaching the electrically-conductive layer to the outer member.

11. A method according to claim 10, comprising attaching the electrically-conductive layer to the outer member at the ends of the outer member.

12. A method according to claim 6, comprising attaching the electrically-conductive layer at the ends of the outer member.

* * * * *